US010262764B2

(12) United States Patent
Amritphale et al.

(10) Patent No.: US 10,262,764 B2
(45) Date of Patent: Apr. 16, 2019

(54) ADVANCED NON-TOXIC RED MUD BASED NANO GEL TYPE FUNCTIONAL RADIATION SHIELDING MATERIALS AND THE PROCESS THEREOF

(71) Applicant: COUNCIL OF SCIENTIFIC AND INDUSTRIAL RESEARCH, New Delhi (IN)

(72) Inventors: Sudhir Sitaram Amritphale, Bhopal (IN); Sarika Verma, Bhopal (IN); Satyabrata Das, Bhopal (IN)

(73) Assignee: Council of Scientific and Industrial Research, New Delhi (IN)

( * ) Notice: Subject to any disclaimer, the term of this patent is extended or adjusted under 35 U.S.C. 154(b) by 0 days.

(21) Appl. No.: 15/795,968

(22) Filed: Oct. 27, 2017

(65) Prior Publication Data

US 2018/0122525 A1 May 3, 2018

(30) Foreign Application Priority Data

Oct. 28, 2016 (IN) ..... 201611037017

(51) Int. Cl.
*G21F 1/02* (2006.01)
*G21F 1/10* (2006.01)

(52) U.S. Cl.
CPC ..... *G21F 1/026* (2013.01); *G21F 1/10* (2013.01); *G21Y 2004/10* (2013.01)

(58) Field of Classification Search
CPC ..... G21F 1/026
See application file for complete search history.

(56) References Cited

U.S. PATENT DOCUMENTS 3,437,602 A 4/1969 Tashlick et al.
7,524,452 B2 4/2009 Amritphale et al.

OTHER PUBLICATIONS

Odano et al., "Development of High-Performance Gel-Type Radiation Sheilding Material Using Polymer Resin", Progress in Nuclear Science and Technology, 2014, vol. 4, pp. 639-642.

*Primary Examiner* — Peter F Godenschwager
(74) *Attorney, Agent, or Firm* — Baker & Hostetler LLP

(57) ABSTRACT

The conventional radiation shielding materials are made using lead, barite and hematite ore which are either toxic, costly and are non-replinshable possessing limited functionality. In view of above, we develop a novel process for making advanced non-toxic Red Mud based functional radiation shielding materials utilizing appropriate novel matrixes like Advanced geopolymer, geopolymeric-polymeric matrix, putty, cement and phosphatic based matrix and are also compatible with conventional matrixes. The appropriate physico-chemical consolidation and or densification of red mud using advanced or conventional matrix helps in obtaining functional radiation shielding material by simultaneous and synergistic chemical reactions among various mineralogical and chemical compounds of red mud with complementary various chemical compounds present in *citrus* fruit peel waste especially citric acid to form nano gel material to obtain the fine "tailored shielding powder". The developed material has broad application spectrum from diagnostic radiation installations like diagnostic X-ray to CT scanner room.

10 Claims, 1 Drawing Sheet

ADVANCED NON-TOXIC RED MUD BASED NANO GEL TYPE FUNCTIONAL RADIATION SHIELDING MATERIALS AND THE PROCESS THEREOF

FIELD OF THE INVENTION

The present invention relates to an advanced non-toxic Red Mud based Nano gel type material for functional radiation shielding materials and a process thereof.

BACKGROUND OF THE INVENTION AND DESCRIPTION OF PRIOR ART

The applications of diagnostic "X" ray radiation are well known in medical sciences. However, there is an always need to overcome the health hazards due to radiations by utilizing appropriate radiation shielding materials.

The conventional shielding materials are made using a) lead which is toxic and otherwise also possess many other important applications e.g. lead acid battery, b) barite which is relatively costly and contains deleterious impurities and c) hematite ore useful for making iron metal. All the three conventional shielding materials namely lead, barite and hematite ore are non-replinshable commodities. Further, the conventional shielding materials possess limited functionality.

In view of above, there is an urgent need to develop advanced radiation shielding materials possessing additional functionality e.g. a) fire resistance, b) heat resistance, c) mold ability and flexibility to the developed material by, employing appropriate novel matrixes for the fabrication of lead, barium and hematite ore free advanced radiation shielding material utilizing red mud based "Nano" gel type material.

The so far known conventional and advanced shielding materials developed till date, utilizes lead, barium and hematite ore based compounds as raw materials and depend on involvement of cumbersome and energy intensive process. Further the use of conventional matrixes limits the functionality aspects which are otherwise very much necessary to face the challenges of new millennium. Conventional polymeric matrixes used in making shielding material are not durable and therefore are prone to health hazard over the years.

In view of above there is an urgent need to develop advanced non-toxic Lead, Barium and Hematite ore free, red mud based "Nano" gel type material useful for making, functional radiation shielding materials utilizing appropriate novel matrixes. The novel matrixes used are 1) Advanced Geopolymer matrix, 2) Advanced geo polymeric matrix, 3) Advanced putty and cement matrix, 4) Advance phosphatic material based matrix, 5) Apart from these novel matrixes the material is also compatible with conventional matrixes, however with the limited functionality as against novel matrixes.

To this end a novel process for making advanced Lead, Barium and Hematite ore free, "Nano" gel, based non-toxic, functional radiation shielding materials has been developed utilizing industrial waste red mud generated in large quantity all over the world in Aluminum producing industries. The developed process is highly energy efficient and environment friendly.

The novel process involves the appropriate physico-chemical consolidation and or densification of red mud using advanced or conventional matrix helps in obtaining functional radiation shielding material. Red mud is an industrial Waste generated in aluminum industry containing 8-10% silica, 28-31% iron oxide, 20-24% alumina, 19-21% titanium oxide, 6-7% sodium oxide and 4-5% calcium oxide. The novel process involves simultaneous and synergistic chemical reactions of various mineralogical and chemical compounds like hematite, anatse, rutile, gibbsite and cancraite of red mud with complementary various chemical compounds present in *citrus* fruit wastes (namely orange peel waste, lemon peel waste etc.) like cellulose, hemicellulose, pectin and especially citric acid to form nano gel material to obtain the fine "tailored shielding powder" useful for making functional radiation shielding materials using various appropriate matrixes.

The genus *Citrus* comprises of about 140 genera and 1,300 species and belongs to the Rutaceae or Rue family, and majorly includes Some important fruits like *Citrus sinensis* (Orange), *Citrus paradisi* (Grapefruit), *Citrus limon* (Lemon), *Citrus reticulata* (tangerine), *Citrus grandis* (shaddock), *Citrus aurantium* (sour orange), *Citrus medica* (Citron), and *Citrus aurantifolia* (lime). *Citrus* are well known as one of the world's major fruit crops that are produced in many countries with tropical or subtropical climate. Brazil, USA, Japan, China, Mexico, Pakistan, and countries of the Mediterranean region, are the major *Citrus* producers. Worldwide, *Citrus* production is estimated to be at levels as high as 105 million metric tons (MMT) per annum, Brazil being the largest producer with contribution of 19.2 MMT followed by the United States. Further, the *citrus* peel waste is generates from the processing of *citrus* fruit, constituting cellulose, hemicellulose, pectin and especially citric acid. The *citrus* peel waste is highly biodegradable, produced worldwide and therefore its disposal has become major environmental concern.

Further apart from achieving technological and functional characteristics in the developed "Advanced non-toxic Lead, Barium and hematite ore free, functional radiation shielding materials, "the process is simple, highly energy efficient, environmental friendly and is also highly cost effective and therefore enabling wide spread utilization of developed material for broad application spectrum ranging from diagnostic radiation installations such as diagnostic X-ray room to CT scanner room etc.

Reference may be made to article "Development of high performance gel type radiation shielding material using polymer resin by Naotero Odano etal. In Progress in nuclear science and technology vol. 4 (2014) pp. 639-642, wherein new gel type shielding material mainly consist of conventional resin, lead powder and boron compound was developed. The drawback of the process is use of toxic lead for the preparation of gel type radiation shielding material.

Reference may be made to patent, Radiation shielding material and method of making same by Rosensweig Alan and Tashlick Irving, U.S. Pat. No. 3,437,602 wherein Radiation shielding material have been developed using hematite ore. The drawback of the process leads to the formation of in-homogeneous radiation shielding matrix.

Reference may be made to patent, low temperature process for making radiaopac materials utilizing industrial/agricultural waste as raw material by S.S Amritphale et al., wherein low temperature process for making radiaopac materials have been disclosed. The drawback of the process is making shielding material by a) sintering in the temperature range of 900-1300° C. and b) need of barium based compounds.

Further, from the hitherto reported prior art it is clear that "Advanced non-toxic Lead, Barium and hematite ore free, Red Mud based "Nano" gel type material useful for making, functional radiation shielding materials utilizing appropriate novel matrixes has not been pursued at all. From the hitherto reported prior art and based on the drawbacks of the known process, the various issues that need to be addressed and problems to be solved for making highly value Advanced non-toxic Lead, Barium and hematite ore free, Red Mud based "Nano" gel type material useful for making, functional radiation shielding materials and also ensuring total utilization of red mud are summarized here as under:—

1) The use of toxic lead for the preparation of gel type shielding materials.

2) The need of use of conventional hematite and barite for making shielding materials.

3) The need of high temperature sintering in the temperature range of 900-1300° C. for making shielding materials.

OBJECTS OF THE INVENTION

The main object of the present invention is to provide Advanced non-toxic Lead, barium and hematite ore free, Red Mud based "Nano" gel type material useful for making, functional radiation shielding materials utilizing appropriate novel matrixes and the process there of.

The use of developed "Nano" gel, based non-toxic, functional radiation shielding materials" lies in the areas of radiation shielding applications e.g. diagnostic radiation installations such as diagnostic X-ray and CT scanner room etc., which obviates the drawbacks of the hitherto known prior art as detailed above.

Another object of the present invention is involving simultaneous and synergistic chemical reactions of various mineralogical and chemical compounds hematite, anatse, rutile, gibbsite and cancraite of red mud with complementary various chemical compounds present in orange peel waste namely cellulose, hemicellulose, pectin and especially citric acid to form nano gel material to obtain the fine "tailored shielding powder".

Another object of the present invention is to provide a novel process involving simultaneous and synergistic chemical reactions of various mineralogical and chemical compounds of Red mud with various constituents of novel matrixes enabling homogeneous radiation shielding matrix with desired functionality.

Another object of the present invention is to provide advanced functional radiation shielding materials which are devoid of conventionally use toxic lead, barium compound and hematite ore.

Still another object of the present invention is to obtain desired homogeneous shielding matrix by chemically designed and mineralogical formulated compositions using various complementary precursors present in red mud and various constituents of novel matrixes.

Still another object of the present invention is a novel approach of making functional shielding material utilizing novel matrixes. The novel matrixes involved are 1) Advanced Geopolymer matrix, 2) Advanced geo polymeric matrix, 3) Advanced putty and cement matrix, 4) Advance phosphatic material based matrix, 5)—Apart from these novel matrixes the material is also compatible with conventional matrixes, however with the limited functionality as against novel matrixes.

Yet another object of the present invention is enabling the development of simple, highly energy efficient, environmental friendly and highly cost effective process enabling wide spread utilization of developed material for broad application spectrum ranging from diagnostic radiation installations such as diagnostic X-ray room to CT scanner room etc.

Yet another object of the present invention is simple as it involves only physico-chemical and mechanical processing of red mud with novel matrix and obviates the need of sintering of red mud at high temperature using various additives like barium sulphate and carbon source etc.

Yet another object of the present invention is independent of use of conventional pure polymeric, ceramic or cementations matrixes.

Yet another object of the present invention is development of functional shielding materials possessing a) heat resistance, b) fire resistance, c) flexibility and moldability aspects.

Yet another object of the present invention is to solve the disposal problem of red mud and *citrus* peel waste and to save the environment all over the world.

SUMMARY OF THE INVENTION

The main field of the present invention essentially involves, Development of Advanced non-toxic Lead, barium and hematite ore free, red mud based "Nano" gel type material useful for making, functional radiation shielding materials utilizing appropriate novel matrixes and the process there of.

Conventionally the basic raw material required for making conventional shielding material involves use of either lead or barium or hematite ore and various appropriate combinations all the three depending on the respective application spectra. Further, the lead being toxic in nature, barite being costly and associate with deleterious material and hematite ore being an important source of making iron metal, thus there is an urgent need to develop radiation shielding material which are free of Lead, Barium and hematite ore. Further the advancement of technology and material, there is an urgent need to develop advanced functional shielding materials.

To this end a novel process for making Advanced Lead, Barium and hematite ore free, "Nano" gel, based non-toxic, functional radiation shielding materials have been developed utilizing industrial waste Red Mud generated in large quantity all over the world in Aluminum producing industries. The developed process is highly energy efficient and environment friendly.

The novel process involves the appropriate physico-chemical consolidation and or densification of red mud using advanced or conventional matrix helps in obtaining functional radiation shielding material. A novel process involving simultaneous and synergistic chemical reactions of various mineralogical and chemical compounds hematite, anatse, rutile, gibbsite and cancraite of red mud with complementary various chemical compounds present in *citrus* peel waste namely cellulose, hemicellulose, pectin and especially citric acid to form nano gel material to obtain the fine "tailored shielding powder".

The *citrus* peel waste is generates from the processing of *citrus* fruit, constituting cellulose, hemicellulose, pectin and especially citric acid. The *citrus* peel waste is highly biodegradable, produced worldwide and therefore its disposal has become major environmental concern.

The chemical reaction among "tailored shielding powder" and various constituents of novel matrixes enables homogeneous radiation shielding matrix with desired functionality in the developed functional shielding materials.

Further, Novel process essentially involves a novel process for making Advanced non-toxic Lead, barium and hematite ore free, Red Mud based "Nano" gel type material useful for making, functional radiation shielding materials utilizing appropriate novel matrixes.

The novelty of the process of the present invention essentially lies in that:

1) The novel process involves simultaneous and synergistic chemical reactions of various mineralogical and chemical compounds hematite, anatse, rutile, gibbsite and cancraite of red mud with complementary various chemical compounds present in *citrus* peel waste namely cellulose, hemicellulose, pectin and especially citric acid to form nano gel material to obtain the fine "tailored shielding powder".

2) The novel process involves the tailored shielding powder so obtained having multi shielding phases due to presence of multi elemental Fe, FeO, $Fe_2O_3$, $TiO_2$, Ti, Al(OH), $SiO_2$.

3) The novel process involves simultaneous and synergistic chemical reactions of various mineralogical and chemical compounds of Red mud with various constituents of novel matrixes enabling homogeneous radiation shielding matrix with desired functionality.

4) The novel process involves advanced functional radiation shielding material which is devoid of conventionally use toxic lead, barium compound and hematite ore.

5) To obtain desired homogeneous shielding matrix by chemically designed and mineralogical formulated compositions using various complementary precursors present in red mud and various constituents of novel matrixes.

6) To enables a novel approach of making functional shielding material utilizing novel matrixes. The novel matrixes involved are 1—Advanced Geopolymer matrix 2—Advanced geo polymeric polymeric matrix 3—Advanced putty and cement matrix 4—Advance phosphatic material based matrix 6—Apart from these novel matrixes the material is also compatible with conventional matrixes, however with the limited functionality as against novel matrixes.

7) The novel process developed is simple, highly energy efficient, environmental friendly and is also highly cost effective enabling wide spread utilization of developed material for broad application spectrum ranging from diagnostic radiation installations such as diagnostic X-ray room to CT scanner room etc.

8) The developed s novel process is simple as it involves only physico-chemical and mechanical processing of red mud with novel matrix and obviates the need of sintering of red mud at high temperature using various additives like barium sulphate and carbon source etc.

9) Another novel aspect of the present invention is independent of use of conventional pure polymeric, ceramic or cementations matrixes.

10) Another novel and non-obvious inventive aspect in present invention is development of functional shielding materials possessing a) heat resistance, b) fire resistance, c) flexibility and moldability aspects etc.

To overcome the drawbacks of the hitherto to known processes, the present novel process involves—

1) The novel process involves simultaneous and synergistic chemical reactions of various mineralogical and chemical compounds hematite, anatse, rutile, gibbsite and cancraite of red mud with complementary various chemical compounds present in *citrus* peel waste namely cellulose, hemicellulose, pectin and especially citric acid to form nano gel material to obtain the fine "tailored shielding powder".

2) The novel process involves the tailored shielding powder so obtained having multi shielding phases due to presence of multi elemental Fe, FeO, $Fe_2O_3$, $TiO_2$, Ti, Al(OH), $SiO_2$.

3) The novel process involves simultaneous and synergistic chemical reactions of various mineralogical and chemical compounds of red mud with various constituents of novel matrixes enabling homogeneous radiation shielding matrix with desired functionality.

4) The novel process involves advanced functional radiation shielding material which is obviates the use of conventionally use toxic lead, barium compound and hematite ore.

5) The novel process involves obtaining desired homogeneous shielding matrix by chemically designed and mineralogical formulated compositions using various complementary precursors present in red mud and various constituents of novel matrixes.

6) The novel process enables a novel approach of making functional shielding material utilizing novel matrixes. The novel matrixes involved are 1) Advanced geopolymer matrix, 2) Advanced geo polymeric polymeric matrix, 3) Advanced putty and cement matrix, 4) Advance phosphatic material based matrix, 5) Apart from these novel matrixes the material is also compatible with conventional matrixes, however with the limited functionality as against novel matrixes.

7) The novel process enables development of is simple, highly energy efficient, environmental friendly and is highly cost effective process enabling wide spread utilization of developed material for broad application spectrum ranging from diagnostic radiation installations such as diagnostic X-ray room to CT scanner room etc.

8) The novel process is simple as it involves only physico-chemical and mechanical processing of Red mud with novel matrix and obviates the need of reduction of red mud at high temperature using various additives like barium sulphate etc and thus making the process highly energy efficient for the development of advance radiation shielding material.

9) Another novel aspect of the present invention is independent of use of conventional pure polymeric, ceramic or cementations matrixes.

10) Another novel aspect in present invention is development of functional shielding materials possessing a) heat resistance, b) fire resistance, c) flexibility and moldability aspects.

In conclusion, the novel process of the present invention enables for making "Advanced non-toxic Lead, Barium and hematite ore free, Red Mud based "Nano" gel type material useful for making, functional radiation shielding materials utilizing appropriate novel matrixes and the process there of".

The use of developed "advanced non-toxic radiation shielding material" lies in the areas of radiation shielding applications e.g. diagnostic radiation installations such as diagnostic X-ray and CT scanner room etc.

Figure 1:
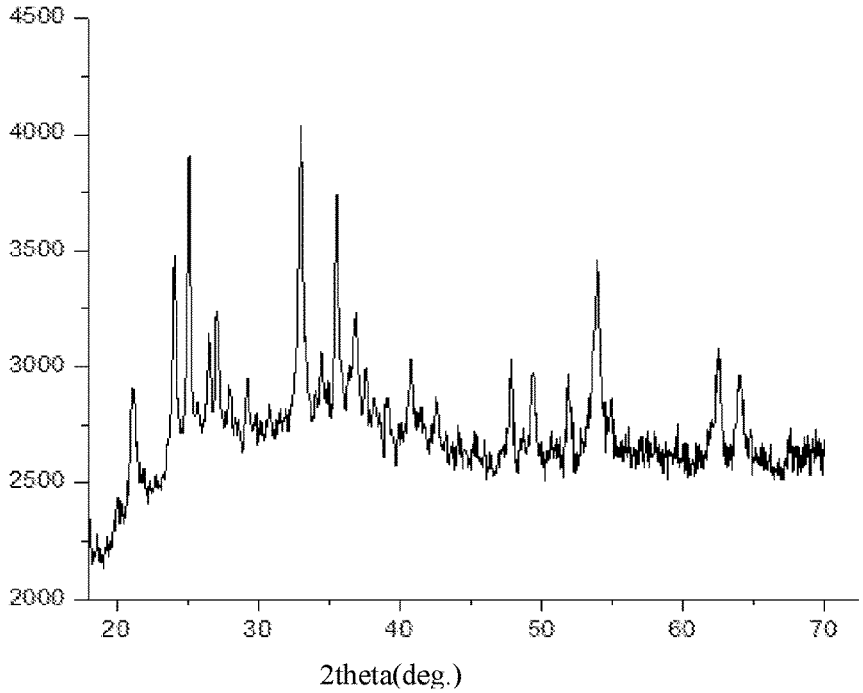
FIG. 1) the "X" ray diffraction results of Red mud as such.
Figure 2:
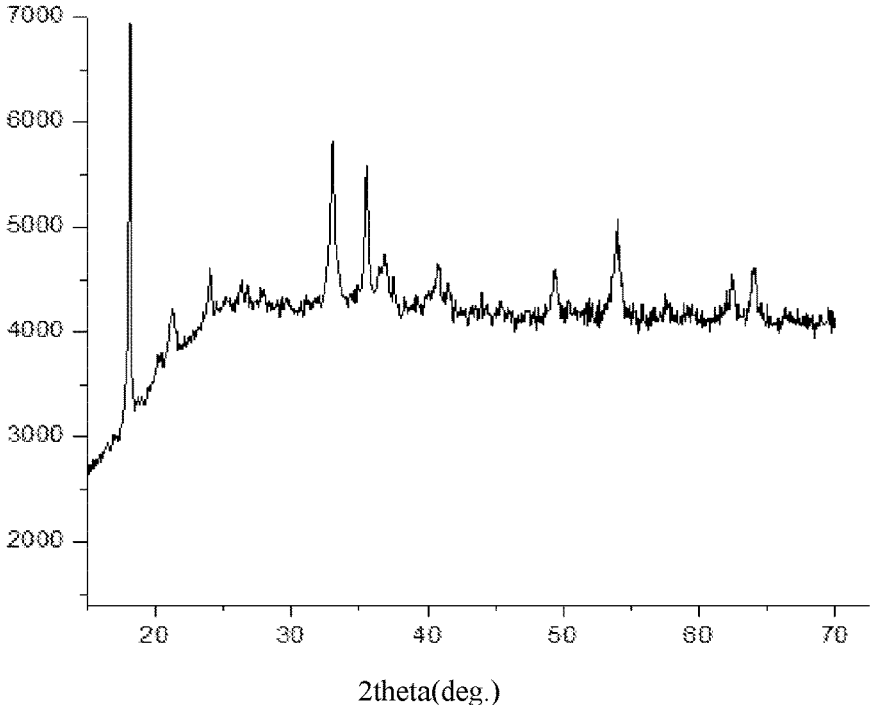
FIG. 2) the "X" ray diffraction results of Red mud based "tailored shielding powder".

Accordingly the present invention provides, Advanced non-toxic Lead, Barium and hematite ore free, Red Mud based "Nano" gel type material useful for making, functional radiation shielding materials utilizing appropriate novel matrixes and the process there of which comprises digesting 100 g-600 g of Red mud with 80-300 g of crushed *citrus* peel waste, in the temperature range of 30° C.-90° C. for a period of 2-6 hours and the digested nano gel material so obtained was further dried in an air oven for duration of 2-3 hours in the temperature range of 100° C.-110° C., which was then grinded to obtain the fine "tailored shielding powder" which was further blended with either of the novel matrixes like:— a) "Advanced geopolymer matrix" for obtaining heat resistance properties in the shielding material by taking 100 g-600 g of tailored shielding powder and mixing it with ground powder of 10 g-60 g fly ash, 2 g-8 g sodium hydroxide and 1 g-4 g sodium silicate and 4 ml-16 ml of water and the material so obtained was compacted in the form of tiles of dimension 10 cm×10 cm×5 mm at a compaction pressure of 100-200 kg/cm$^2$ b) "Advanced geopolymeric-polymeric matrix" for obtaining flexible and moldable properties by taking 100 g-600 g of tailored shielding powder and mixing it firstly with ground powder of 1 g-6 g fly ash, 1 g-2 g sodium hydroxide and 0.5 g-1 g sodium silicate and 4 ml-10 ml of water and followed by blending with 150 g to 650 g of Silicone rubber or 150 g to 650 g of PDMS and curing the material in the mold of desired dimension in the temperature range of 30 to 60 degree centigrade for a period ranging from 24 hours to 30 minutes for obtaining the advanced flexible and moldable shielding material, c) Advance putty matrix based material for plastering the X-ray room by taking 100 g-600 g of tailored shielding powder and blending it with 20 g to 60 g of conventional putty and applying on wall by adapting conventional practices, d) Advance cement matrix based material for plastering the X-ray room by taking 100 g-600 g of tailored shielding powder and blending it with 10 g to 50 g of conventional cement and applying on wall by adapting conventional practices, e) Advance phosphatic matrix based material for plastering the X-ray room by taking 100 g-600 g of tailored shielding powder and blending it with 10 ml to 50 ml of conventional orthophosphoric acid or sodium hexametaphosphate and applying on wall by adapting conventional practices, and f) also the appropriate physico-chemical consolidation and or densification of red mud by using unique gravity fractionalization of red mud or digested red mud, advanced or conventional matrix helps in obtaining functional radiation shielding material.

A novel process which comprises digesting of 100 g-600 g of Red mud with 80 g-300 g of crushed *citrus* peel waste, in the temperature range of 30° C.-90° C. for a period of 2-6 hours to obtain digested nano gel material.

A novel process which comprises further drying of digested nano gel material so obtained in an air oven for duration of 2-3 hours in the temperature range of 100° C.-110° C.

A novel process in which the above dried nano gel material was then grinded to obtain the fine "tailored shielding powder" for making functional shielding materials using advanced and conventional matrixes.

A novel process in which for obtaining heat resistance properties in the shielding material using "Advanced geo polymer matrix" by taking 100 g-600 g of tailored shielding powder and mixing it with ground powder of 10 g-60 g fly ash, 2 g-8 g sodium hydroxide and 1 g-4 g sodium silicate and 4 ml-16 ml of water and the material so obtained was compacted in the form of tiles of dimension 10 cm×10 cm×5 mm at a compaction pressure of 100-200 kg/cm$^2$.

A novel process in which for obtaining flexible and moldable properties in the in the shielding material using "Advance geopolymeric-polymeric matrix" by taking 100 g-600 g of tailored shielding powder and mixing it firstly with ground powder of 1 g-6 g fly ash, 1 g-2 g sodium hydroxide and 0.5 g-1 g sodium silicate and 4 ml-10 ml of water and followed by blending with 150 g to 650 g of Silicone rubber or 150 g to 650 g of PDMS and curing the material in the mold of desired dimension in the temperature range of 30 to 60 degree centigrade for a period ranging from 24 hours to 30 minutes for obtaining the advanced flexible and moldable shielding material.

A novel process in which Advance putty matrix based shielding material for plastering the X-ray room by taking 100 g-600 g of tailored shielding powder and blending it with 20 g to 60 g of conventional putty and applying on wall by adapting conventional practices.

A novel process in which Advance cement matrix based shielding material for plastering the X-ray room is developed by taking 100 g-600 g of tailored shielding powder and blending it with 10 g to 50 g of Conventional cement and applying on wall by adapting conventional practices.

A novel process in which Advance phosphatic matrix based shielding material for plastering the X-ray room is developed by taking 100 g-600 g of tailored shielding powder and blending it with 10 ml to 50 ml of conventional ortho phosphoric acid or sodium hexametaphosphate and applying on wall by adapting conventional practices.

A novel process in which the appropriate physico-chemical consolidation and or densification of red mud using advanced or conventional matrix helps in obtaining functional radiation shielding material.

The novel and non-obvious inventive step in the present invention involves simultaneous and synergistic chemical reactions of various mineralogical and chemical compounds hematite, anatse, rutile, gibbsite and cancraite of red mud with complementary various chemical compounds present in orange peel waste namely cellulose, hemicellulose, pectin and especially citric acid to form nano gel material to obtain the fine "tailored shielding powder".

The novel and non-obvious inventive step in the present invention is the tailored shielding powder so obtained and is having multi shielding phases due to presence of multi elemental Fe, FeO, $Fe_2O_3$, $TiO_2$, Ti, Al(OH), $SiO_2$.

The novel and non-obvious inventive step in the present invention is the tailored shielding powder so obtained is possesses particle ranging from micron to nano size.

The novel and non-obvious inventive step in the present invention is chemical reaction among "tailored shielding powder" and various constituents of novel matrixes enabling homogeneous radiation shielding matrix with desired functionality.

The other novel and non-obvious inventive aspect in present invention is to provide advanced functional radiation shielding materials which are devoid of conventionally used toxic lead, barium compound and hematite ore.

The other novel and non-obvious inventive step in present invention is to obtain desired homogeneous shielding matrix by chemically designed and mineralogical formulated compositions using various complementary precursors present in red mud and various constituents of novel matrixes.

The other novel and non-obvious inventive aspect in present invention is the novel approach of making functional shielding material utilizing novel matrixes. The novel matrixes involved are 1—Advanced Geopolymer matrix, 2—Advanced geo polymeric polymeric matrix, 3—Advanced putty and cement matrix, 4—Advance phosphatic material based matrix, 5—Apart from these novel matrixes the material is also compatible with conventional matrixes, however with the limited functionality as against novel matrixes.

The other novel and non-obvious inventive aspect in present invention is the development of simple, highly energy efficient, environmental friendly and the cost effective process enabling wide spread utilization of developed material for broad application spectrum ranging from diagnostic radiation installations such as diagnostic X-ray room to CT scanner room etc.

The other novel and non-obvious inventive aspect in present invention simple as it involves only physico-chemical and mechanical processing of red mud with novel matrix and obviates the need of sintering of red mud at high temperature using various additives like barium sulphate and carbon source etc.

The other novel and non-obvious inventive aspect in present invention is independent of use of conventional pure polymeric, ceramic or cementations matrixes.

The other novel and non-obvious inventive aspect in present invention is development of functional shielding materials possessing a) heat resistance, b) Fire resistance, c) flexibility and moldability aspects.

Accordingly, present invention provides an advanced non-toxic Red Mud based functional radiation shielding materials which comprises;

a) 55.6 wt %-66.7 wt % of Red mud;

b) 44.4 wt %-33.3 wt % of crushed *citrus* peel waste.

In an embodiment, an advanced non-toxic Red Mud based functional radiation shielding materials (85.47 wt %-87.20 wt %) further comprises fly ash in the range of 8.54 wt %-8.72 wt %, sodium hydroxide in the range of 1.70 wt %-1.16 wt %, sodium silicate in the range of 0.85 wt %-0.581 wt % and water in the range of 3.41 wt %-2.32 wt % to obtain Heat resistant properties of the shielding material.

In further embodiment an advanced non-toxic Red Mud based functional radiation shielding materials is further comprises Silicone rubber in the range of 58.47 wt %-51.22 wt % or poly di-methyl siloxane (PDMS) in the range of 58.47 wt %-51.22 wt % to obtain flexible and moldable properties of the shielding material.

In yet another embodiment, an advanced non-toxic Red Mud based functional radiation shielding materials (83.4 wt %-90.90 wt %) further comprises either putty in the range of 16.6 wt %-9.10 wt % of or cement in the range of 9.1 wt %-7.7 wt % or ortho phosphoric acid in the range of 9.1 wt %-7.7 wt % of or sodium hexametaphosphate in the range of 9.1 wt %-7.7 wt % for plastering the room for X-ray shielding.

In yet another embodiment, a process for manufacturing of an advanced non-toxic Red Mud based functional radiation shielding materials comprises;

a. digesting 55.6 wt %-66.7 wt % of Red mud with 44.4 wt %-33.3 wt % of crushed *citrus* peel waste, in the temperature range of 30° C.-90° C. for a period of 2-6 hours to form a nano gel material;

b. the said nano gel is dried in an air oven for the duration of 2-3 hours in the temperature range of 100° C.-110° C. and grinded to make "tailored shielding powder";

c. the said tailored shielding powder is mixed with ground powder of 8.54 wt %-8.72 wt % of fly ash, 1.70 wt %-1.16 wt % of sodium hydroxide, 0.85 wt %-0.581 wt % of sodium silicate and 3.41 wt %-2.32 wt % of water to obtain Advanced geo polymer matrix.

d. the said tailored shielding powder is optionally mixed with 0.39 wt %-0.472 wt % of fly ash, 0.39 wt %-0.157 wt % of sodium hydroxide, 0.2 wt %-0.07 wt % of sodium silicate and 1.55 wt %-0.788 wt % of water and followed by blending with 58.47 wt %-51.22 wt % of Silicone rubber or 58.47 wt %-51.22 wt % of PDMS to obtain 'Advance geopolymeric-polymeric matrix'.

In yet another embodiment a process for manufacturing of an advanced non-toxic Red Mud based functional radiation shielding materials wherein an Advanced geo polymer matrix so obtained is compacted in the form of tiles of dimension 10 cm×10 cm×5 mm at a compaction pressure of 100-200 kg/cm$^2$.

In yet another embodiment, a process for manufacturing of an advanced non-toxic Red Mud based functional radiation shielding materials wherein Advance geopolymeric-polymeric matrix is cured in the mold of desired dimension in the temperature range of 30 to 60 degree centigrade for a period ranging from 24 hours to 30 minutes for obtaining the advanced flexible and moldable shielding material.

In yet another embodiment, a process for manufacturing of an advanced non-toxic Red Mud based functional radiation shielding materials wherein Advance putty matrix is made for plastering the X-ray room by taking tailored shielding powder and blending it with conventional putty.

In yet another embodiment, a process for manufacturing of an advanced non-toxic Red Mud based functional radiation shielding materials wherein advance cement matrix is made for plastering the X-ray room by taking of tailored shielding powder and blending it with of Conventional cement.

In yet another embodiment, a process for manufacturing of an advanced non-toxic Red Mud based functional radiation shielding materials wherein Advance phosphatic matrix is made for plastering the X-ray room by taking tailored shielding powder and blending it with conventional ortho phosphoric acid or sodium hexametaphosphate.

The following examples are given by way of illustration of the working of the invention in actual practice and therefore should not be construed to limit the scope of the present invention in any way.

EXAMPLE 1

For making ""Advanced non-toxic Lead, Barium and hematite ore free, Red Mud based "Nano" gel type material useful for making, functional radiation shielding materials utilizing appropriate novel matrixes like "Advanced geo polymer matrix" for obtaining heat resistance properties in the shielding material, comprises of digesting 100 g of Red mud with 80 g of crushed orange peel waste, in the temperature of 30° C. for a period of 2 hours. The digested nano gel material so obtained was further dried in an air oven for duration of 2 hours at the temperature of 100° C. and which was then grinded to obtain the fine "tailored shielding powder". Further, 100 g of tailored shielding powder was then mixed with 10 g fly ash, 2 g sodium hydroxide, 1 g sodium silicate and 4 ml of water, the material so obtained was compacted in the form of tiles of dimension 10 cm×10 cm×5 mm at a compaction pressure of 100 kg/cm$^2$.

The X-ray radiation shielding attenuation properties of developed sample having thickness 5 mm were studied using Nomex multimeter from PTW. The X-ray machine used for testing is DX 525—a 500 mA, 125 Kvp X-ray machine of Wipro GE make. The evaluation was done at 100 Kvp of X ray and the % attenuation was found to be 80. The density of the tile is found to be 2.68 g/cm$^3$. The impact strength of the sample was found to be 0.026 kgfm·cm$^{-1}$ and water absorption in the range of 18.0%.

EXAMPLE 2

For making Advanced non-toxic Lead, Barium and hematite ore free, Red Mud based "Nano" gel type material useful for making, functional radiation shielding materials utilizing appropriate novel matrixes like "Advanced geo polymer matrix" for obtaining heat resistance properties in the shielding material, comprises of digesting 600 g of Red mud with 300 g of crushed orange peel waste, in the temperature of 90° C. for a period of 6 hours. The digested nano gel material so obtained was further dried in an air oven for duration of 2 hours at the temperature of 110° C. and which was then grinded to obtain the fine "tailored shielding powder". Further, 600 g of tailored shielding powder was then mixed with 60 g fly ash, 8 g sodium hydroxide, 4 g sodium silicate and 4 ml of water. The material so obtained was compacted in the form of tiles of dimension 10 cm×10 cm×5 mm at a compaction pressure of 200 kg/cm$^2$.

The X-ray radiation shielding attenuation properties of developed sample having thickness 5 mm were studied using Nomex multimeter from PTW. The X-ray machine used for testing is DX 525—a 500 mA, 125 Kvp X-ray machine of Wipro GE make. The evaluation was done at 100 Kvp of X-ray and the % attenuation was found to be 85.

The density of the tile is found to be 2.88 g/cm$^3$. The impact strength of the sample was found to be 0.029 kgfm·cm$^{-1}$ and water absorption in the range of 17.0%.

EXAMPLE 3

For making Advanced non-toxic Lead, Barium and hematite ore free, Red Mud based "Nano" gel type material useful for making, functional radiation shielding materials utilizing appropriate novel matrixes like "Advanced geo polymer polymer matrix" for obtaining for obtaining flexible and moldable properties in the shielding material, comprises of digesting 100 g of Red mud with 80 g of crushed orange peel waste, in the temperature of 30° C. for a period of 2 hours. The digested nano gel material so obtained was further dried in an air oven for duration of 2 hours at the temperature of 100° C. and which was then grinded to obtain the fine "tailored shielding powder". Further, 100 g of tailored shielding powder was then mixed with 100 g of tailored shielding powder and mixing it firstly with ground powder of 1 g fly ash, 1 g sodium hydroxide and 0.5 g sodium silicate and 4 ml of water and followed by blending with 150 g of Silicone rubber or 150 g of PDMS and curing the material in the mold of dimension 15 cm×15 cm×5 mm at the temperature of 30 degree centigrade for a period for 30 minutes for obtaining the advanced flexible and moldable shielding material.

The X-ray radiation shielding attenuation properties of developed sample having thickness 5 mm were studied using Nomex multimeter from PTW. The X-ray machine used for testing is DX 525—a 500 mA, 125 Kvp X-ray machine of Wipro GE make. The evaluation was done at 100 Kvp of X-ray and the % attenuation was found to be 83. The density of the material was found to be 2.66 g/cm$^3$.

EXAMPLE 4

For making Advanced non-toxic Lead, Barium and hematite ore free, Red Mud based "Nano" gel type material useful for making, functional radiation shielding materials utilizing appropriate novel matrixes like "Advanced geo polymer polymer matrix" for obtaining for obtaining flexible and moldable properties in the shielding material, comprises of digesting 600 g of Red mud with 300 g of crushed orange peel waste, in the temperature of 90° C. for a period of 6 hours. The digested nano gel material so obtained was further dried in an air oven for duration of 2 hours at the temperature of 100° C. and which was then grinded to obtain the fine "tailored shielding powder". Further, 600 g of tailored shielding powder was then mixed with 6 g fly ash, 2 g sodium hydroxide and 1 g sodium silicate and 10 ml of water and followed by blending with 650 g of PDMS and curing the material in the mold of dimension 15 cm×15 cm 5 mm dimension at the temperature of 60 degree centigrade for a period of 30 minutes for obtaining the advanced flexible and moldable shielding material.

The X-ray radiation shielding attenuation properties of developed sample having thickness 5 mm were studied using Nomex multimeter from PTW. The X-ray machine used for testing is DX 525—a 500 mA, 125 Kvp X-ray machine of Wipro GE make. The evaluation was done at 100 Kvp of X ray and the % attenuation was found to be 88. The density of the material was found to be 2.99 g/cm$^3$.

EXAMPLE 5

For making "Advanced non-toxic Lead, Barium and hematite ore free, Red Mud based "Nano" gel type material useful for making, functional radiation shielding materials utilizing appropriate novel matrixes like Advance putty matrix for plastering the X-ray room, comprises of digesting 100 g of Red mud with 80 g of crushed orange peel waste, in the temperature of 30° C. for a period of 2 hours. The digested nano gel material so obtained was further dried in an air oven for duration of 2 hours at the temperature of 100° C. and which was then grinded to obtain the fine "tailored shielding powder". Further, 100 g tailored shielding powder was blended with 20 g of conventional putty and applying on wall by adapting conventional practices.

The X-ray radiation shielding attenuation properties of developed sample were studied using Nomex multimeter from PTW. The X-ray machine used for testing is DX 525—a 500 mA, 125 Kvp x-ray machine of Wipro GE make. The evaluation was done at 100 Kvp of X ray and the % attenuation was found to be 84.

EXAMPLE 6

For making "Advanced non-toxic Lead, Barium and hematite ore free, Red Mud based "Nano" gel type material useful for making, functional radiation shielding materials utilizing appropriate novel matrixes like Advance putty matrix for plastering the X-ray room, comprises of digesting 600 g of Red mud with 300 g of crushed orange peel waste, in the temperature of 90° C. for a period of 6 hours. The digested nano gel material so obtained was further dried in an air oven for duration of 2 hours at the temperature of 100° C. and which was then grinded to obtain the fine "tailored shielding powder". Further, 600 g tailored shielding powder was blended with 60 g of conventional putty and applying on wall by adapting conventional practices.

The X-ray radiation shielding attenuation properties of developed sample were studied using Nomex multimeter from PTW. The X-ray machine used for testing is DX 525—a 500 mA, 125 Kvp X-ray machine of Wipro GE make. The evaluation was done at 100 Kvp of X ray and the % attenuation was found to be 89.

EXAMPLE 7

For making Advanced non-toxic Lead, Barium and hematite ore free, Red Mud based "Nano" gel type material useful for making, functional radiation shielding materials utilizing appropriate novel matrixes like cement matrix based material for plastering the X-ray room, comprises of digesting 100 g of Red mud with 80 g of crushed orange peel waste, in the temperature of 30° C. for a period of 2 hours. The digested nano gel material so obtained was further dried in an air oven for duration of 2 hours at the temperature of 100° C. and which was then grinded to obtain the fine "tailored shielding powder". Further, 100 g tailored shielding powder was blended with 10 g of conventional cement and applying on wall by adapting conventional practices.

The X-ray radiation shielding attenuation properties of developed sample were studied using Nomex multimeter from PTW. The X-ray machine used for testing is DX 525—a 500 mA, 125 Kvp X-ray machine of Wipro GE make. The evaluation was done at 100 Kvp of X ray and the % attenuation was found to be 84.

EXAMPLE 8

For making "Advanced non-toxic Lead, Barium and hematite ore free, Red Mud based "Nano" gel type material useful for making, functional radiation shielding materials utilizing appropriate novel matrixes like cement matrix based material for plastering the X-ray room, comprises of digesting 600 g of Red mud with 300 g of crushed orange peel waste, in the temperature of 90° C. for a period of 6 hours. The digested nano gel material so obtained was further dried in an air oven for duration of 3 hours at the temperature of 110° C. and which was then grinded to obtain the fine "tailored shielding powder". Further, 100 g tailored shielding powder was blended with 50 g of conventional cement and applying on wall by adapting conventional practices.

The X-ray radiation shielding attenuation properties of developed sample were studied using Nomex multimeter from PTW. The X-ray machine used for testing is DX 525—a 500 mA, 125 Kvp X-ray machine of Wipro GE make. The evaluation was done at 100 Kvp of X ray and the % attenuation was found to be 88.

EXAMPLE 9

For making "Advanced non-toxic Lead, Barium and hematite ore free, Red Mud based "Nano" gel type material useful for making, functional radiation shielding materials utilizing appropriate novel matrixes like advance phosphatic matrix based material for plastering the X-ray room, comprises of digesting 100 g of red mud with 80 g of crushed *citrus* peel waste, in the temperature of 30° C. for a period of 2 hours. The digested nano gel material so obtained was further dried in an air oven for duration of 2 hours at the temperature of 100° C. and which was then grinded to obtain the fine "tailored shielding powder". Further, 100 g tailored shielding powder was blended with 10 ml of conventional ortho phosphoric acid and applying on wall by adapting conventional practices.

The X-ray radiation shielding attenuation properties of developed sample were studied using Nomex multimeter from PTW. The X-ray machine used for testing is DX 525—a 500 mA, 125 Kvp X-ray machine of Wipro GE make. The evaluation was done at 100 Kvp of X ray and the % attenuation was found to be 86.

EXAMPLE 10

For making "Advanced non-toxic Lead, Barium and hematite ore free, Red Mud based "Nano" gel type material useful for making, functional radiation shielding materials utilizing appropriate novel matrixes like "Advanced geo polymer matrix" for obtaining heat resistance properties in the shielding material, comprises of digesting 100 g of Red mud with 50 g of crushed lemon peel waste, in the temperature of 30° C. for a period of 1 hours. The digested nano gel material so obtained was further dried in an air oven for duration of 2 hours at the temperature of 100° C. and which was then grinded to obtain the fine "tailored shielding powder". Further, 100 g of tailored shielding powder was then mixed with 10 g fly ash, 2 g sodium hydroxide, 1 g sodium silicate and 4 ml of water. The material so obtained was compacted in the form of tiles of dimension 10 cm×10 cm×5 mm at a compaction pressure of 100 kg/cm$^2$.

The X-ray radiation shielding attenuation properties of developed sample having thickness 5 mm were studied using Nomex multimeter from PTW. The X-ray machine used for testing is DX 525—a 500 mA, 125 Kvp X-ray machine of Wipro GE make. The evaluation was done at 100 Kvp of X ray and the % attenuation was found to be 90. The density of the tile is found to be 2.88 g/cm$^3$. The impact strength of the sample was found to be 0.029 kgfm·cm$^{-1}$ and water absorption in the range of 16.0%.

EXAMPLE 11

For making Advanced non-toxic Lead, Barium and hematite ore free, Red Mud based "Nano" gel type material useful for making, functional radiation shielding materials utilizing appropriate novel matrixes like "Advanced geo polymer matrix" for obtaining heat resistance properties in the shielding material, comprises of digesting 500 g of Red mud with 300 g of crushed grapefruit peel waste, in the temperature of 90° C. for a period of 8 hours. The digested nano gel material so obtained was further dried in an air oven for duration of 2 hours at the temperature of 110° C. and which was then grinded to obtain the fine "tailored shielding powder". Further, 600 g of tailored shielding powder was then mixed with 60 g fly ash, 8 g sodium hydroxide, 4 g sodium silicate and 4 ml of water. The material so obtained was compacted in the form of tiles of dimension 10 cm×10 cm×5 mm at a compaction pressure of 200 kg/cm$^2$.

The X-ray radiation shielding attenuation properties of developed sample having thickness 5 mm were studied using Nomex multimeter from PTW. The X-ray machine used for testing is DX 525—a 500 mA, 125 Kvp X-ray machine of Wipro GE make. The evaluation was done at 100 Kvp of X-ray and the % attenuation was found to be 78.

The density of the tile is found to be 2.58 g/cm$^3$. The impact strength of the sample was found to be 0.023 kgfm·cm$^{-1}$ and water absorption in the range of 19.0%.

The Main Advantages of the Present Invention are:

The developed novel process for making involves "ADVANCED NON-TOXIC LEAD, BARIUM AND HEMATITE ORE FREE, RED MUD BASED "NANO" GEL TYPE MATERIAL USEFUL FOR MAKING, FUNCTIONAL RADIATION SHIELDING MATERIALS UTILIZING APPROPRIATE NOVEL MATRIXES AND THE PROCESS THERE OF", is advantageous due to the following reasons:— a) The advantage of the developed novel process is to ensure total utilization of two industrial waste red mud and *citrus* fruit peel waste for making highly value added material.

b) The advantage of the novel process is it's highly energy efficient process as the novel process involves reaction of red mud with *citrus* peel waste at the temperature of 30 to 80° C. of as it does not involves sintering of red mud based compound in the range of the temperature 900-1300° C.

c) The advantage of the novel process involves designing of raw materials and processing parameters, enabling synergistic and simultaneous chemical reactions among the various reactants which enable to obtain micron to nano tailored shielding precursor for obtaining non-toxic radiation shielding material.

d) The developed shielding precursor is compatible with in advanced as well as all the conventional shielding matrixes.

e) Other advantage of the developed novel process is to convert a red waste material in to a highly value added advanced non-toxic radiation shielding materials possessing homogeneous radiation shielding matrix.

f) Other advantage of the developed novel process is to ensure total utilization of two industrial waste red mud and *citrus* peel waste for making highly value added material.

g) Other advantage of the developed novel process is to utilize and save the cost of costly chemicals inherently present in red mud and orange peel waste otherwise required for making advanced non-toxic radiation shielding materials.

h) Other advantage of the developed novel process is to solve the disposal problem of both the waste and to save the environment all over the world and thus the process is environment friendly.

i) Materials helps in obtaining homogeneous radiation shielding material which is one of the important characteristic of shielding materials which lacks to certain extend in conventional shielding materials.

The invention claimed is:

1. A red mud based nano gel type functional radiation shielding material comprising:

a) 55.6 wt %-66.7 wt % of red mud; and b) 44.4 wt %-33.3 wt % of crushed *citrus* peel waste.

2. A red mud based nano gel type functional radiation shielding material as claimed in claim 1, comprising:

the shielding material in the range of 85.47 wt %-87.20 wt %, fly ash in the range of 8.54 wt %-8.72 wt %, sodium hydroxide in the range of 1.70 wt %-1.16 wt %, sodium silicate in the range of 0.85 wt %-0.581 wt %, and water in the range of 3.41 wt %-2.32 wt % to obtain heat resistant properties of the shielding material.

3. A red mud based nano gel type functional radiation shielding material as claimed in claim 1, comprising:

the shielding material in the range of 41.53 wt %-48.78 wt %, and

Silicone rubber in the range of 58.47 wt %-51.22 wt % or poly di-methyl siloxane (PDMS) in the range of 58.47 wt %-51.22 wt % to obtain flexible and moldable properties of the shielding material.

4. A red mud based nano gel type functional radiation shielding material as claimed in claim 1, comprising:

the shielding material in the range of 83.4 wt %-90.90 wt %, and putty in the range of 16.6 wt %-9.10 wt % or cement in the range of 9.1 wt %-7.7 wt % or ortho phosphoric acid in the range of 9.1 wt %-7.7 wt % or sodium hexametaphosphate in the range of 9.1 wt %-7.7 wt % for plastering a room for X-ray shielding.

5. A process for manufacturing of a red mud based nano gel type functional radiation shielding material, the process comprising;

a. digesting red mud in the range of 55.6 wt %-66.7 wt % with crushed *citrus* peel waste in the range of 44.4 wt %-33.3 wt %, at a temperature in the range of 30° C.-90° C. for a period of 2-6 hours to form a nano gel material;

b. the nano gel material is dried in an air oven for the duration of 2-3 hours at a temperature in the range of 100° C.-110° C. and then grinded to obtain a tailored shielding powder;

c. the tailored shielding powder of step (b) is mixed with ground powder having fly ash in the range of 8.54 wt %-8.72 wt %, sodium hydroxide in the range of 1.70 wt %-1.16 wt %, sodium silicate in the range of 0.85 wt-0.581 wt % and water in the range of 3.41 wt %-2.32 wt % to obtain a geo polymer matrix; or d. the tailored shielding powder of step (b) is mixed with fly ash in the range of 0.39 wt %-0.472 wt %, sodium hydroxide in the range of 0.39 wt %-0.157 wt %, sodium silicate in the range of 0.2 wt %-0.07 wt % and water in the range of 1.55 wt %-0.788 wt % and then blended with silicone rubber in the range of 58.47 wt %-51.22 wt % or PDMS in the range of 58.47 wt %-51.22 wt % to obtain a geopolymeric-polymeric matrix.

6. The process as claimed in claim 5, wherein the geo polymer matrix of step (c) is compacted at a pressure in the range of 100-200 kg/cm$^2$ to obtain tiles of dimension 10 cm×10 cm×5 mm.

7. The process as claimed in claim 5, wherein the geo-polymeric-polymeric matrix of step (d) is cured in mold of a desired dimension at a temperature in the range of 30 to 60° C. for a period ranging from 30 minutes to 24 hours to obtain a flexible and moldable shielding material.

8. The process as claimed in claim 5, wherein the tailored shielding powder is blended with putty for obtaining putty matrix for plastering an X-ray room.

9. The process as claimed in claim 5, wherein the tailored shielding powder is blended with cement for obtaining cement matrix for plastering an X-ray room.

10. The process as claimed in claim 5, wherein the tailored shielding powder is blended with ortho phosphoric acid or sodium hexametaphosphate for obtaining phosphate matrix for plastering an X-ray room.

* * * * *